United States Patent [19]

Boyd et al.

[11] Patent Number: 4,813,147

[45] Date of Patent: Mar. 21, 1989

[54] APPARATUS FOR INTERACTING WITH BOTH SIDES OF A TWO-SIDED STRIP

[75] Inventors: David M. Boyd; Daniel L. Barwick, both of Palmyra; Dennis H. Chestnut, Harrisburg; Timothy W. Jones, Lancaster; Douglas M. Walburn; Larry J. Wilt, both of Harrisburg, all of Pa.

[73] Assignee: AMP Incorporated, Harrisburg, Pa.

[21] Appl. No.: 32,119

[22] Filed: Mar. 27, 1987

[51] Int. Cl.[4] ..... G01B 7/10

[52] U.S. Cl. ..... 33/501.03; 33/834; 33/783

[58] Field of Search ..... 33/147 R, 147 N, 147 L, 33/143 R, 143 L, 169 F; 324/329, 330, 331; 378/89; 226/100, 197, 108, 168

[56] References Cited

U.S. PATENT DOCUMENTS

| | | | |
|---|---|---|---|
| 448,583 | 3/1891 | Medart . | |
| 1,001,644 | 8/1911 | Hutchings . | |
| 1,168,198 | 1/1916 | Hanson . | |
| 2,107,451 | 2/1938 | Oppenlaender . | |
| 2,855,518 | 10/1958 | Foley et al. . | |
| 2,897,371 | 7/1959 | Hasler | 378/89 X |
| 3,333,753 | 8/1967 | Streets . | |
| 3,703,097 | 11/1972 | Kilpatrich | 33/147 L X |
| 3,909,987 | 10/1975 | MacCarthy, Sr. . | |
| 3,984,679 | 10/1976 | Lublin et al. . | |
| 4,017,897 | 4/1977 | Blanding . | |
| 4,063,820 | 12/1977 | Borgese . | |
| 4,098,136 | 7/1978 | Wicker et al. . | |
| 4,162,528 | 7/1979 | Maidonado et al. . | |
| 4,192,612 | 3/1980 | Bodlaj . | |
| 4,229,652 | 10/1980 | Weinstock et al. . | |
| 4,264,202 | 4/1981 | Gugliotta et al. . | |
| 4,393,313 | 7/1983 | Calkins et al. . | |
| 4,434,366 | 2/1984 | Spongr et al. . | |
| 4,441,133 | 4/1984 | Ogawa et al. . | |
| 4,510,577 | 4/1985 | Tsujii et al. . | |
| 4,553,217 | 11/1985 | Daudt et al. . | |

FOREIGN PATENT DOCUMENTS

| | | | |
|---|---|---|---|
| 2829264 | 2/1979 | Fed. Rep. of Germany | 324/229 |

*Primary Examiner*—Harry N. Haroian
*Attorney, Agent, or Firm*—Katherine A. Nelson

[57] ABSTRACT

A thickness monitoring system for measuring the thickness of layer disposed on both sides of a two sided strip includes a thickness measuring device, a first set of guide rollers mounted to guide the strip past the thickness measuring device along a first path, a set of guide pulleys mounted to invert the strip and to offset the strip laterally with respect to the first path, and a second set of guide rollers which guide the inverted strip past the thickness measuring device along the second path. The thickness measuring device is mounted for movement along a third path which is transverse to the first and second paths to allow the thickness measuring device to monitor either side of the strip by positioning the measuring device in alignment with the respective one of the first and second paths.

23 Claims, 6 Drawing Sheets

Fig. 2
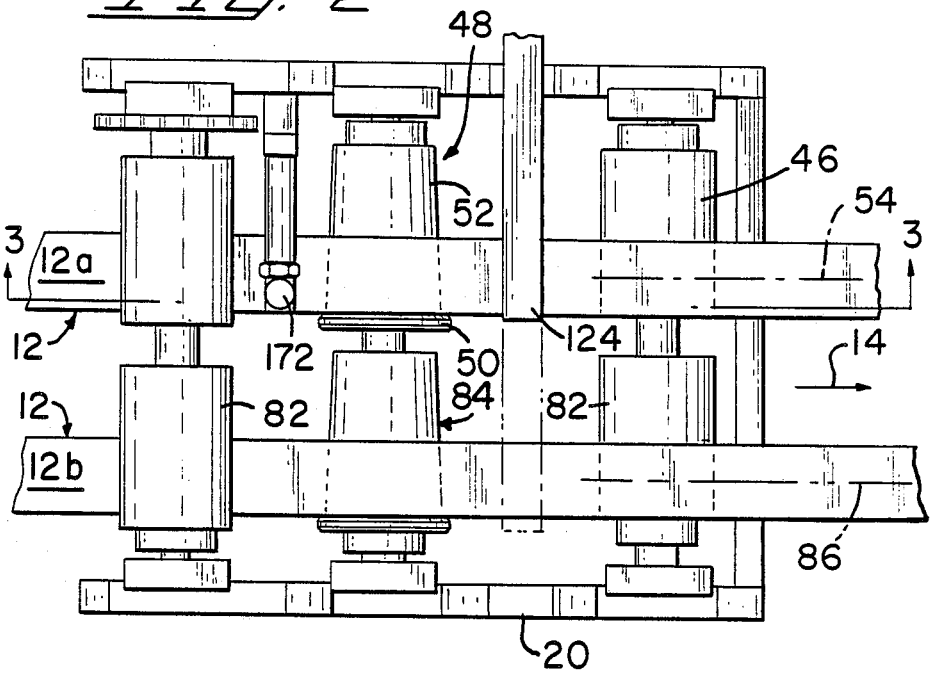
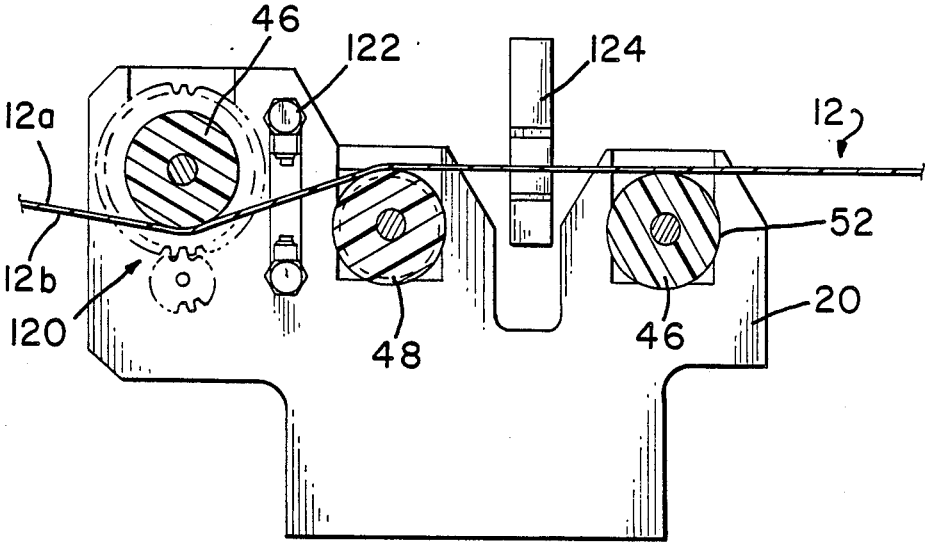
Fig. 3

APPARATUS FOR INTERACTING WITH BOTH SIDES OF A TWO-SIDED STRIP

BACKGROUND OF THE INVENTION

This invention relates to an apparatus for interacting with both sides of a two-sided strip in a single pass of the strip through the apparatus.

In many applications, it is important to monitor or process both sides of a two-sided strip. For example, when a strip is plated with a layer of metal such as gold on both sides, it is often important to monitor the thickness of the two layers. In the past, it has been common practice to utilize two separate thickness monitors for this purpose. Note for example, Foley U.S. Pat. No. 2,855,518 which uses two separate thickness monitors, one positioned to monitor each side of the strip. The disadvantage of this approach is that the cost and complexity of the entire system is greatly increased due to the duplication of parts.

SUMMARY OF THE INVENTION

The present invention is directed to an improved apparatus which to a large extent overcomes these disadvantages.

According to this invention, an apparatus is provided for interacting with both sides of a two-sided strip which moves along a transport axis. The apparatus of this invention includes means for interacting with the strip at an interaction site, and means for directing the strip past the interacting means. This directing means includes first means for guiding the strip past the interacting means in a first region with one side of the strip directed to the interacting means, means for inverting the strip, and second means for guiding the inverted strip past the interacting means in a second region alongside the first region, with the other side of the strip directed to the interacting means. In the preferred embodiment described below, the interacting means is a thickness measuring device which monitors a localized region of the strip, and the thickness measuring device is mounted to shift the monitoring site along a path having a component transverse to the transport axis such that the monitoring site is movable between the first and second regions to allow the measuring device to monitor both sides of the strip.

This invention provides the important advantage that only a single interacting means can be used to interact with both sides of the strip in a single pass of the strip through the apparatus. In this way, the cost and complexity of the apparatus is kept to a minimum, and reliability is significantly improved. Though the preferred embodiment described below utilizes a thickness measuring device as an example of a suitable interacting means, it should be clearly understood that this invention is not so limited. To the contrary, this invention can be used with a wide variety of means for either monitoring or processing a two-sided strip. For example, the interacting means can include processing means such as a plating system which uses techniques such as spray, flow or submersion techniques for plating materials onto the strip, or it can include a stamping system. The term "interacting means" is used in this specification and the following claims in its broad sense to cover all such monitoring and processing systems.

The invention itself, together with further objects and attendant advantages, will best be understood by reference to the following detailed description, taken in conjunction with the accompanying drawings.

BRIEF DESCRIPTION OF THE DRAWINGS

FIG. 2 is a fragmentary plan view of a portion of the embodiment of FIG. 1;

FIG. 3 is a cross section taken along line 3—3 of FIG. 2;

DETAILED DESCRIPTION OF THE PRESENTLY PREFERRED EMBODIMENTS

Figure 1:
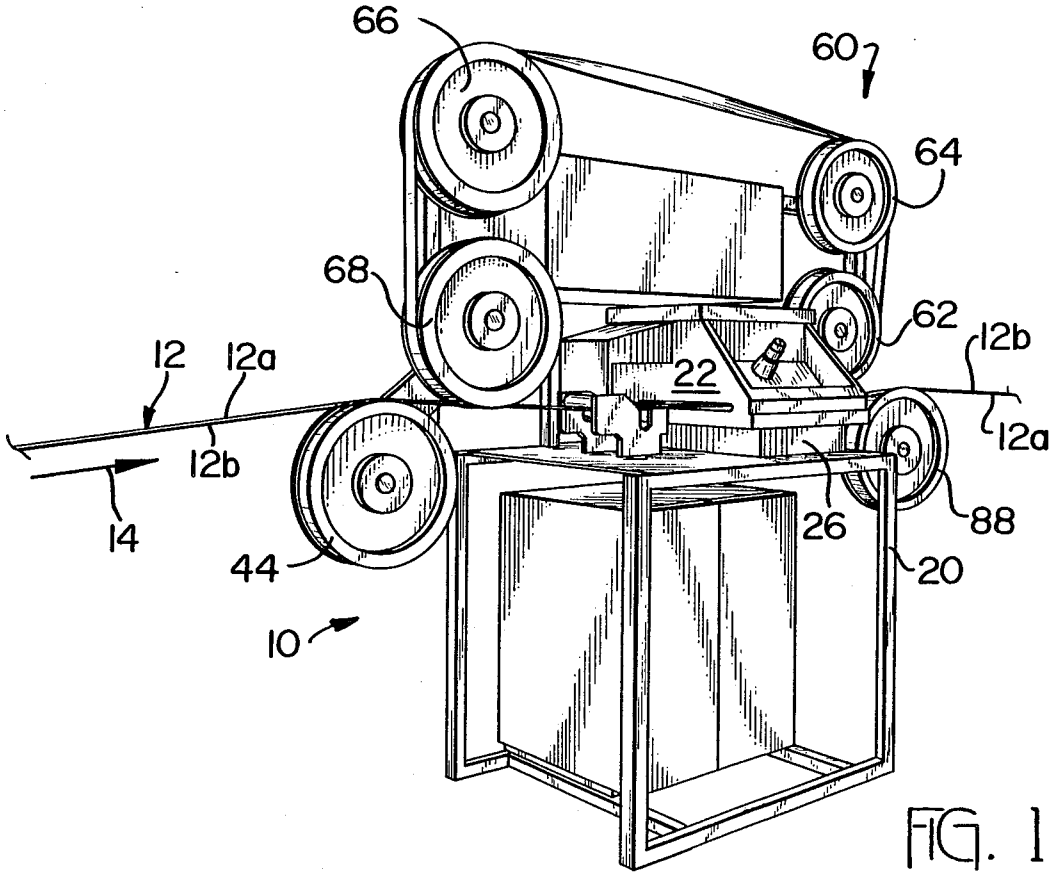
FIG. 1 is a perspective view of a thickness monitoring system which incorporates a presently preferred embodiment of this invention.

Turning now to the drawings, FIG. 1 shows a perspective view of a thickness monitoring system 10 which incorporates a presently preferred embodiment of this invention. This thickness monitoring system 10 is used to monitor the thickness of plating layers on both sides **12*a*, 12*b* of a two-sided strip 12. The strip 12 is moved through the thickness monitoring system 10 along a transport axis 14, from left to right as shown in FIG. 1**, by means (not shown) which form no part of this invention.

The thickness monitoring system 10 includes a frame 20 on which all of the remaining components are mounted. A thickness measuring device 22 is mounted to the frame 20 by means of a translation stage 26. This translation stage 26 guides the movement of the thickness measuring device 22 in the direction shown by the arrow 28 of FIG. 6. As the thickness measuring device 22 is moved transversely with respect to the transport axis 14, an X-ray head 24 included in the device 22 (shown in phantom) moves along the path shown by reference numeral 30 in FIG. 4. The structure and operation of the thickness measuring device 22 do not themselves form part of this invention. Any suitable conventional device can be used, as for example the device described in co-pending patent application Ser. No. 06/821,645, assigned to the assignee of the present invention.

Figure 4:
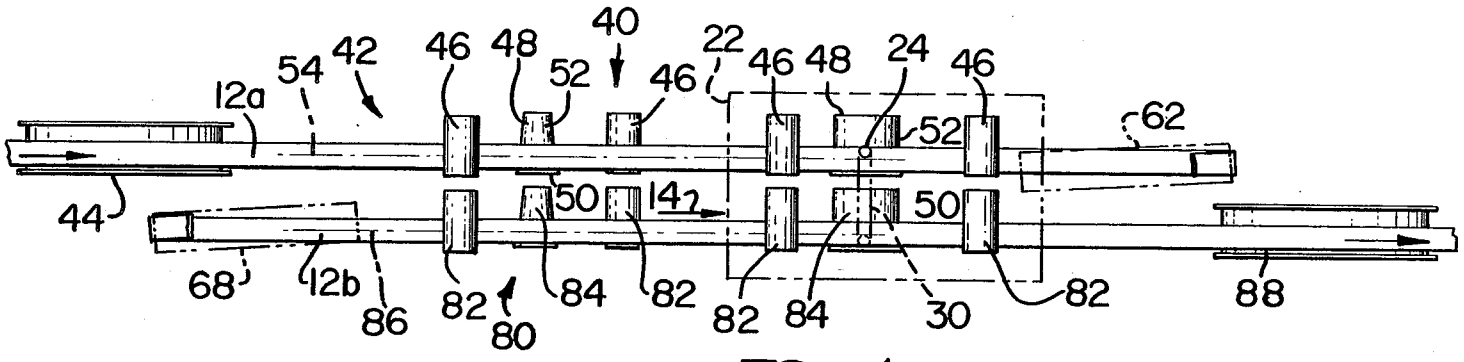
FIG. 4 is a schematic view showing the layout of guide rollers in the embodiment of FIG. 1.
Figure 5:
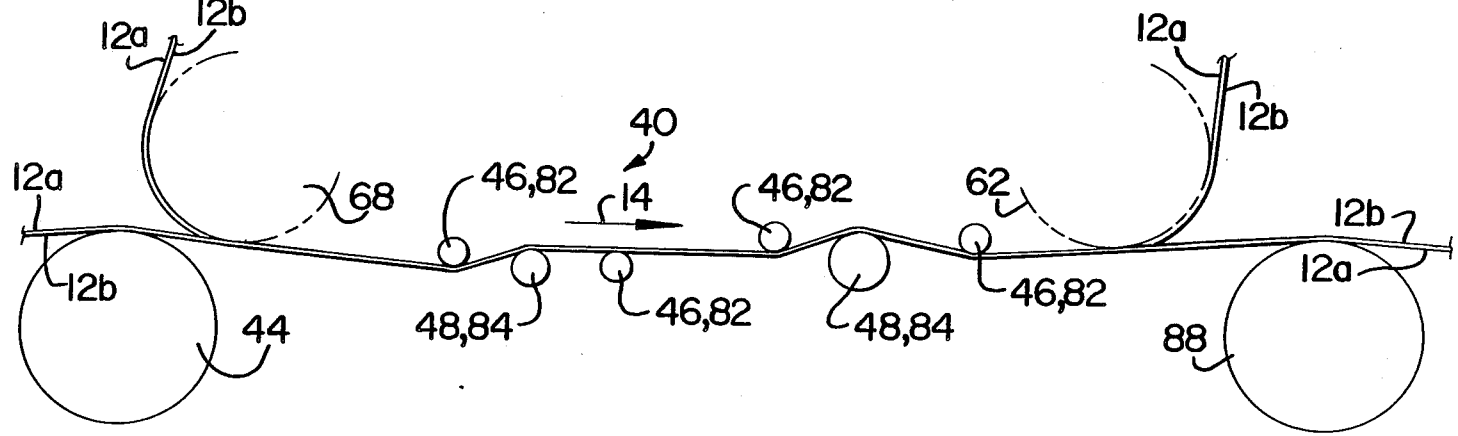
FIG. 5 is a side view of the guide rollers of FIG. 4.

The thickness monitoring system 10 includes means 40 for directing the strip 12 past the thickness monitor 22 (FIGS. 4 and 5). This directing means 40 includes a first means 42 for guiding the strip 12 along a first path indicated by the symbol 54 in FIG. 4. This first guiding means 42 includes an entrance pulley 44 and a set of guide rollers 46 and tapered guide rollers 48. The pulley 44 and the rollers 46, 48 are each mounted to rotate freely in order to minimize friction and relative movement between the strip 12 and the pulley 44 and rollers 46, 48. In this embodiment the guide rollers 46 are cylindrical and the tapered guide rollers 48 are provided with a tapered roller surface 52. Each tapered roller surface defines a smaller diameter end and a larger diameter end, and the larger diameter end is positioned immediately adjacent to a flange 50. In the preferred embodiment for a strip width of up to and including one and one-half inches, the angle of taper of the tapered guide roller 48 under the X-ray head 24 is preferably 0.2°, and the angle of taper of the remaining tapered guide rollers 48 is 2°. The tapered guide rollers 48 cause the strip 12 to position itself with an edge of the strip 12 against the flanges 50, thereby precisely positioning the strip 12 with respect to the first path 54. For strip widths greater than one and one-half inches, the angle of the taper of the rollers may be decreased. Generally the angle of the taper on the rollers exterior to X-ray head 24 is such that the strip is securely held against flanges 50 thereby allowing the taper of the roller under X-ray head 24 to be maintained at a minimum angle to achieve accurate positioning of the strip under head 24.

Figure 6:
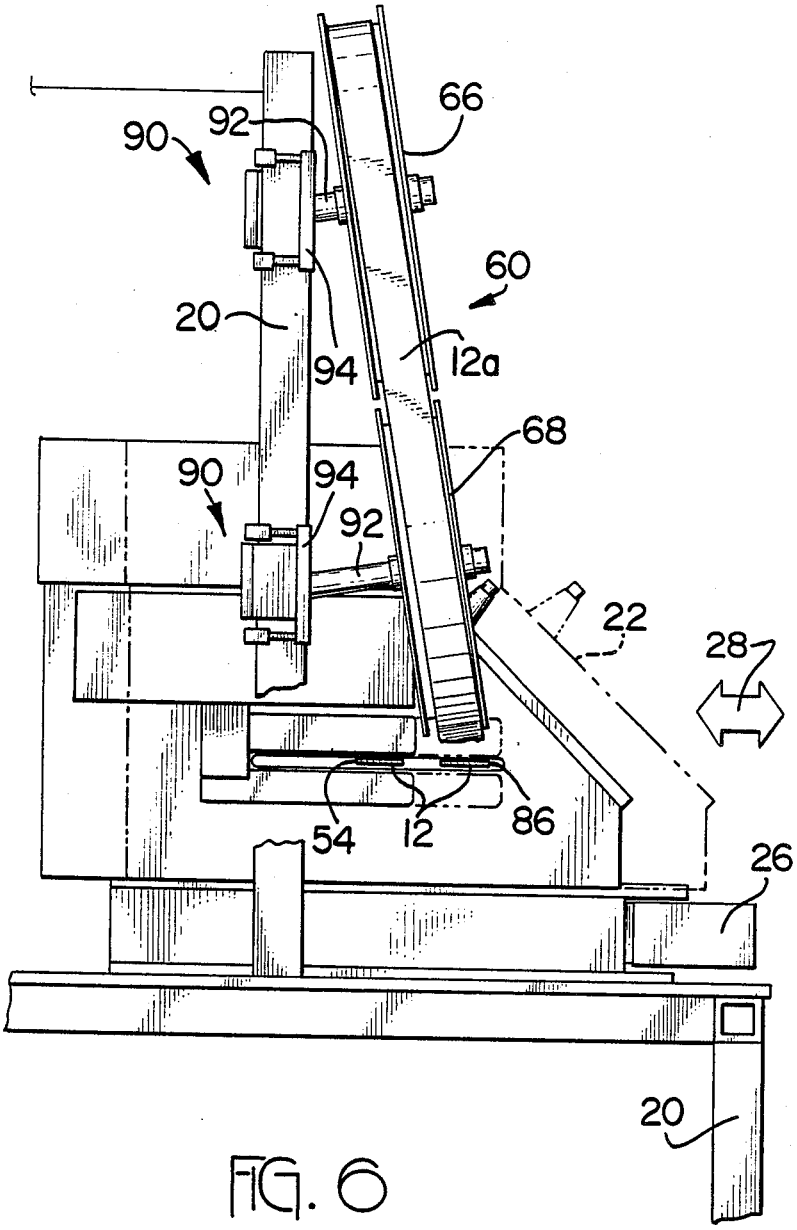
FIG. 6 is an end view of the embodiment of FIG. 1.

The directing means 40 also includes means 60 for inverting the strip 12 (FIGS. 1 and 6). The inverting means 60 in this embodiment includes four guide pulleys 62, 64, 66, 68. Each of the guide pulleys 62-68 is mounted to rotate freely on a respective shaft 92. The shafts 92 are skewed with respect to the guide rollers 46, 48 in such a manner as to cause the strip 12 to be returned in a loop to the entrance region of the directing means 40. The strip 12 is rotated by 180° between the guide rollers 64, 66, as shown in FIG. 1, such that the strip as it emerges from the guide pulley 68 is inverted with respect to the strip as it emerges from the entrance pulley 44.

The directing means 40 also includes a second means 80 for guiding the inverted strip 12 along a second path 86 past the thickness measuring device 22 (FIG. 4). The second guiding means 80 includes cylindrical guide rollers 82 and tapered guide rollers 84 which correspond to respective ones of the rollers 46, 48 described above. The inverted strip 12 then passes to an exit pulley 88 which conducts the strip 12 away from the thickness monitoring system 10. FIG. 5 shows a schematic elevation clarifying the manner in which the rollers 46, 48, 82, 84 and the pulleys 44, 62, 68, 88 cooperate with one another to control the lateral position of the strip 12. FIG. 6 shows the manner in which the inverting means 60 shifts the strip 12 laterally from the first path 54 to the second path 86.

Figure 7:
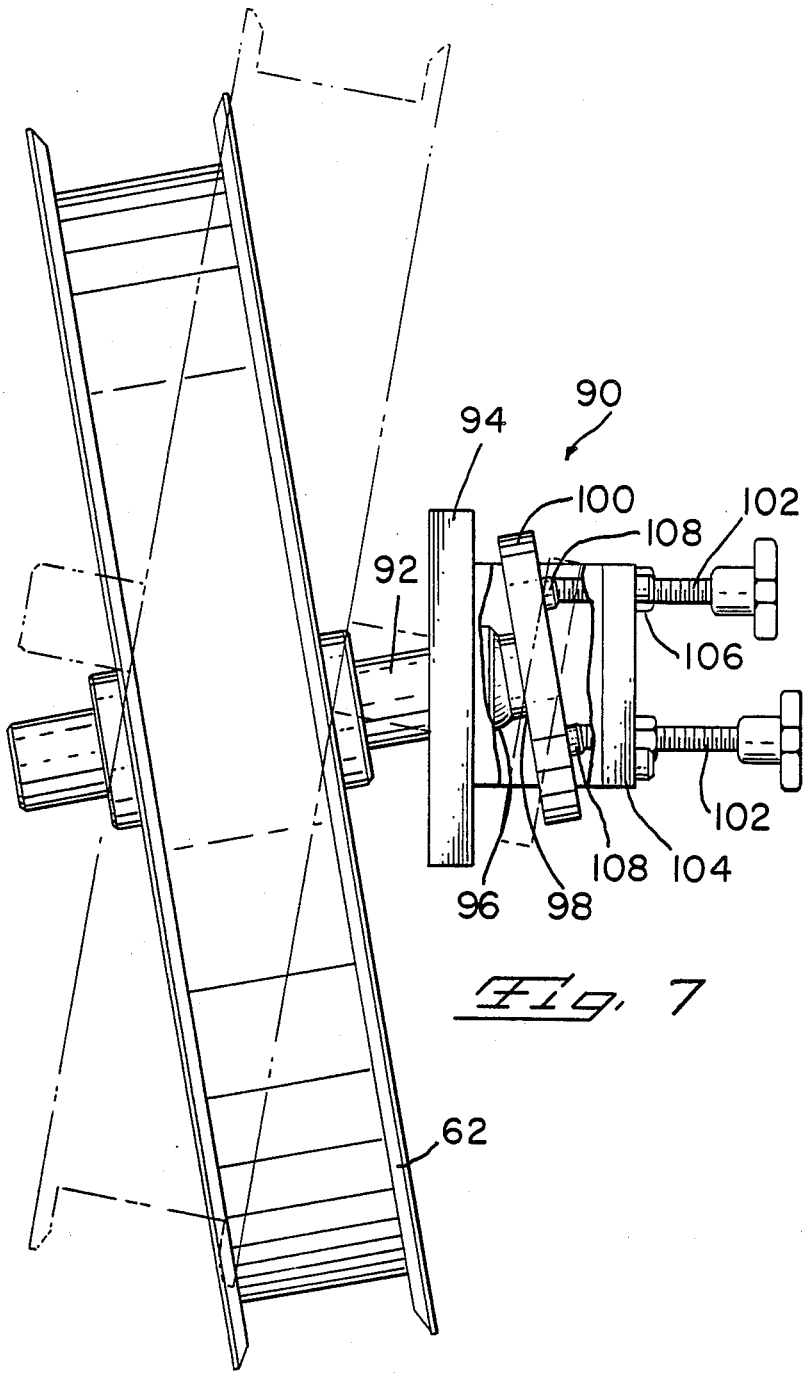
FIG. 7 is a fragmentary elevational view in partial cut away of the mounting system for one of the guide rollers of the embodiment of FIG. 1.
Figure 8:
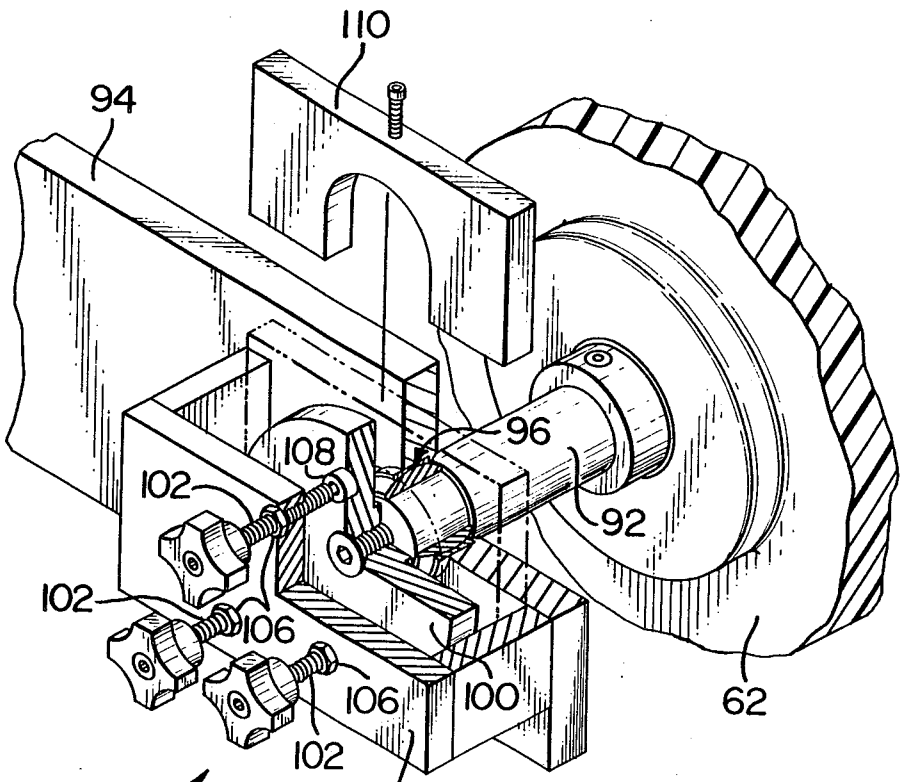
FIG. 8 is a perspective view in partial cut away of the mounting system of FIG. 7.

FIGS. 7 and 8 clarify the manner in which the guide pulleys 62, 64, 66, 68 are adjustably secured in position to the frame 20 such that the skew angle of the guide pulleys can be adjusted as necessary to provide proper tracking for the strip 12 (FIG. 6). A tilt angle adjusting system 90 tilts the skew angle of the shaft 92 on which each of the guide pulleys is mounted. Each of the tilt angle adjusting systems 90 includes a mounting plate 94 through which the shaft 92 passes (FIG. 7). A ball joint 96 interconnects the shaft 92 with the mounting plate 94 such that the shaft 92 is free to articulate with respect to the mounting plate 94. The end 98 of the shaft 92 remote from the guide pulley supports a skewing disk 100. The skewing disk 100 is rigidly secured in place to the shaft 92 such that the orientation of the skewing disk 100 controls the orientation of the shaft 92. An adjusting plate 104 is rigidly mounted to the mounting plate 94 and threadedly engages three adjusting screws 102. Each of the adjusting screws 102 is provided with a respective lock nut 106 and a bearing surface 108. The bearing surfaces 108 are preferably formed of metal and are free to articulate about the end of the adjusting screw 102 in order to conform to the angle of the skewing disk 100.

The tilt angle adjusting system 90 allows each of the shafts 92 to be reproducably positioned as desired. When it is desired to maintain the shafts 92 parallel to the guide rollers 46, 82, a spacer plate 110 can be interposed between the mounting plate 94 and the skewing disk 100 (FIG. 8). The spacer plate 110 has a thickness substantially equal to the separation between the mounting plate 94 and the skewing disk 100 such that the skewing disk 100 is forced into a position in which the skewing disk 100 is parallel to the mounting plate 94. The three adjusting screws 102 can then be positioned against the skewing disk 100 to define a reference position for each of the adjusting screws 102. Then, when it is desired to skew the shaft 92 to a predetermined angle, the spacer plate 110 is removed and each of the adjusting screws 102 is moved by a predetermined number of turns in a predetermined direction. When the adjusting screws 92 are firmly tightened in position, the lock nuts 106 can be used to immobilize the adjusting screws 102. In this way, the shaft 92 can reproducably be oriented and locked at a selected angle. As yet another advantage, the skewing disk 100 is separated by a substantial distance from the ball joint 96. This provides a high degree of sensitivity to the tilt angle adjusting system 90 in that a relatively small change in the tilt angle of the shaft 92 generates a relatively large change in the position of the skewing disk 100.

The thickness monitoring system 10 can also include additional components which do not themselves form part of this invention. For example, one of the guide rollers 46 can be geared to a speed sensing system 120 such as a conventional tachometer. In this way, it can be determined automatically whether the strip 12 is moving. Similarly, sensors 122, 124 similar to the shoulder find sensor and the duty cycle sensor described in the above identified U.S. patent application Ser. No. 06/821,645 can be provided. These features of the thickness monitoring system 10 may enhance the operation of the thickness measuring device 22, but they do not form part of this invention and are therefore not described here in greater detail.

From the foregoing description it should be apparent that an improved thickness monitoring system has been described which allows a single thickness measuring device 22 to be used to monitor the thickness of a plating layer on both sides of the strip 12. As the strip passes the thickness measuring device 22 guided by the first guiding means 42 on the first path 54, the first side 12a of the strip is presented to the thickness measuring device 22. By simply moving the X-ray head 24 into alignment with the first path 54, the thickness of any portion of the plating layer on the first side **12*a* of the strip 12 can be measured. The inverting means 60 then inverts and laterally offsets the strip such that it is a second side 12*b* of the strip which is presented to the thickness measuring device 22 when the inverted strip is moved past the thickness measuring device by the second guiding means 80 along the second path 86. By merely moving the X-ray head 24 into alignment with the second path 86 any portion of the plating layer on the second side 12*b* of the strip 12 can be measured for thickness. In that the same thickness measuring device 22 and X-ray head 24 are used to measure the plating layer on both sides of the strip 12, the simplicity and cost of the thickness monitoring system 10 are minimized and its reliability is increased. Furthermore, all of these benefits are obtained without significantly increasing the size or complexity of the thickness monitoring system 10**.

Of course, it should be understood that a wide range of changes and modifications can be made to the preferred embodiment described above. As pointed out previously, a wide variety of measuring and processing devices can be substituted for the thickness measuring device 22. Furthermore, it is not essential in all embodiments that the strip be returned to the entrance region of the system before the second pass. In some embodiments it is preferable to cause the strip to loop around a guide system such that it travels in a reverse direction in the second path as compared with the first path. Furthermore, when the present invention is used with interacting means having a relatively broad zone of interaction, it may not be necessary in all cases to mount the interacting means for translation between the first and second paths. Of course, the system of this invention can be used either with continuous ribbon strips or formed strips of components. It is therefore intended that the foregoing detailed description be regarded as illustrative rather than limiting, and that it be understood that it is the following claims, including all equivalents, which are intended to define the scope of this invention.

I claim:

1. An apparatus for interacting with both sides of a two-sided strip which moves along a transport axis, said apparatus comprising:

means for interacting with the strip at an interaction site;

means for directing the strip past the interacting means, said directing means comprising:

first means for guiding the strip past the interacting means in a first region with one side of the strip directed to the interacting means;

means for inverting the strip; and second means for guiding the inverted strip past the interacting means in a second region alongside the first region with the other side of the strip directed to the interacting means; and means for mounting the interacting means to shift the interaction site along a path having a component transverse to the transport axis such that the intraction site is moveable between the first and second regions to allow the interacting means to interact with both sides of the strip.

2. The apparatus of claim 1 wherein the interacting means comprises a layer thickness measuring device.

3. The apparatus of claim 1 wherein the mounting means comprises means for translating the interacting means transverse to the transport axis.

4. The apparatus of claim 1 wherein the first and second means comprise at least one roller positioned to contact and guide the strip, said roller comprising:

a tapered roller surface having a larger diameter end and a smaller diameter end; and a flange mounted adjacent the larger diameter end to contact and guide an edge of the strip.

5. The apparatus of claim 1 wherein the directing means defines an entrance region and an exit region, wherein the first and second means both guide the strip in the same direction from the entrance region to the exit region, and wherein the inverting means receives the strip from the first means, returns the strip from the exit region to the entrance region, and supplies the inverted strip to the second means.

6. The apparatus of claim 5 wherein the inverting means comprises:

a first guide pulley positioned adjacent the exit region to receive the strip from the first means;

a second guide pulley positined to receive the strip from the first guide pulley and to initiate inversion of the strip;

a third guide pulley positioned to receive the inverted strip from the second guide pulley; and a fourth guide pulley positioned adjacent the entrance region to receive the inverted strip from the third guide pulley and to supply the inverted strip to the second means.

7. The invention of claim 1 wherein the directing means comprises:

a shaft;

a rotatable member mounted to rotate on the shaft to contact and guide the strip;

a mounting plate;

a ball joint which mounts the shaft to the mounting plate such that the shaft is tiltable with respect to the mounting plate;

a tilt angle control plate secured rigidly to the shaft;

a plurality of adjusting screws; and means for threadedly mounting the adjusting screws to the mounting plate such that the adjusting screws bear on the control plate to adjust and lock the tilt angle of the shaft with respect to the mounting plate.

8. The apparatus of claim 6 wherein the first and second means comprise at least one roller positioned to contact and guide the strip, said roller comprising:

a tapered roller surface having a larger diameter end and a smaller diameter end; and a flange mounted adjacent the larger diameter end to contact and guide an edge of the strip.

9. An apparatus for interacting with both sides of a two-sided strip which moves along a transport axis, said apparatus comprising:

means for interacting with a portion of the strip facing a selected direction;

means for directing the strip past the interacting means from an entrance region to an exit region, said directing means comprising:

first means for guiding the strip past the interacting means in a first path from the entrance region to the exit region with one side of the strip facing in the selected direction to enable the interacting means to interact with said one side;

means for reversing the direction of the strip to return the strip from the exit region to the entrance region and for inverting the strip; and second means for guiding the inverted strip past the interacting means in a second path from the entrance region to the exit region with the other side of the strip facing the selected direction to enable the interacting means to interact with the other side.

10. The apparatus of claim 9 wherein the interacting means interacts with the strip at an interaction site and wherein the apparatus further comprises means for mounting the interacting means for movement across the strip such that the interaction site can be selectively positioned on the strip at the first path or on the inverted strip at the second path.

11. The apparatus of claim 9 wherein the interacting means comprises a layer thickness measuring device.

12. The apparatus of claim 10 wherein the mounting means comprises means for translating the interacting means transverse to the transport axis.

13. The apparatus of claim 9 wherein the first and second means comprise at least one roller positioned to contact and guide the strip, said roller comprising:

a tapered roller surface having a larger diameter end and a smaller diameter end; and a flange mounted adjacent the larger diameter end to contact and guide an edge of the strip.

14. The apparatus of claim 9 wherein the reversing and inverting means comprises:

a first guide pulley positioned adjacent the exit region to receive the strip from the first means;

a second guide pulley positioned to receive the strip from the first guide pulley and to initiate inversion of the strip;

a third guide pulley positioned to receive the inverted strip from the second guide pulley; and a fourth guide pulley positioned adjacent the entrance region to receive the inverted strip from the third guide pulley and to supply the inverted strip to the second means.

15. The apparatus of claim 9 wherein the directing means comprises:

a shaft;

a rotatable member mounted to rotate on the shaft to contact and guide the strip;

a mounting plate;

a ball joint which mounts the shaft to the mounting plate such that the shaft is tiltable with respect to the mounting plate;

a tilt angle control plate secured rigidly to the shaft;

a plurality of adjusting screws;

means for threadedly mounting the adjusting screws to the mounting plate such that the adjusting screws bear on the control plate to adjust and lock the tilt angle of the shaft with respect to the mounting plate.

16. The apparatus of claim 15 wherein the first and second means comprise at least one roller positioned to contact and guide the strip, said roller comprising:

a tapered roller surface having a larger diameter end and a smaller diameter end; and a flange mounted adjacent the larger diameter end to contact and guide an edge of the strip.

17. An apparaatus for measuring the thickness of layers disposed on respective sides of a strip which moves along a transport axis, said apparatus comprising:

a layer thickness measuring device which measures the thickness of a selected layer on a measuring axis;

a frame, which defines an entrance and an exit;

a first set of guide rollers mounted to the frame and aligned with the transport axis to guide the strip past the thickness measuring device along a first path from the entrance to the exit with a first side of the strip directed to the thickness measuring device;

a set of guide pulleys mounted to the frame to guide the strip from the first path at the exit to a second path at the entrance, said second path being laterally offset from and substantially in the plane of the first path, said guide pulleys positioned to invert the strip;

a second set of guide rollers mounted to the frame and aligned with the transport axis to guide the inverted strip past the thickness measuring device along the second path from the entrance to the exit with a second side of the strip, opposite the first side, directed to the thickness measuring device; and means for mounting the thickness measuring device to the frame for movement along a third path which is angled with respect to the first and second paths to move the measuring axis between the first and second paths to allow the thickness measuring device to monitor either side of the strip by positioning the measuring device in alignment with the respective one of the first and second paths.

18. The apparatus of claim 17 wherein the third path is transverse to the first and second paths.

19. The apparatus of claim 17 wherein at least one of the guide rollers comprises:

a tapered roller surface having a larger diameter end and a smaller diameter end; and a flange mounted adjacent the larger diameter end to contact and guide an edge of the strip.

20. The apparatus of claim 17 wherein the set of guide pulleys comprises:

a first guide pulley positioned adjacent the exit to receive the strip from the first set of guide rollers;

a second guide pulley positioned to receive the strip from the first guide pulley and to initiate inversion of the strip;

a third guide pulley positioned to receive the inverted strip from the second guide pulley; and a fourth guide pulley positioned adjacent the entrance to receive the inverted strip from the third guide pulley and to supply the inverted strip to the second set of guide rollers.

21. The apparatus of claim 17 wherein at least one of the guide pulleys is rotatably mounted on a shaft, wherein the shaft is adjustably secured to the frame by a mounting assembly, and wherein the mounting assembly comprises:

a mounting plate secured to the frame;

a ball joint which mounts the shaft to the mounting plate such that the shaft is tiltable with respect to the mounting plate;

an adjusting plate secured rigidly to the shaft;

a plurality of adjusting screws; and means for threadedly mounting the adjusting screws to the mounting plate such that the adjusting screws bear on the control plate to adjust and lock the tilt angle of the shaft with respect to the mounting plate.

22. The apparatus of claim 21 wherein each of the adjusting screws comprises a respective bearing surface which is mounted to articulate with respect to the screw to contact the control plate.

23. The apparatus of claim 21 further comprising a plurality of lock nuts, each mounted on a respective one of the adjusting screws to lock the adjusting screw in position with respect to the mounting plate.

* * * * *